US012061007B2

(12) United States Patent
Hovardas et al.

(10) Patent No.: US 12,061,007 B2
(45) Date of Patent: Aug. 13, 2024

(54) A2L COMPLIANT CONTACTOR

(71) Applicant: Carrier Corporation, Palm Beach Gardens, FL (US)

(72) Inventors: Sotiri T. Hovardas, Indianapolis, IN (US); Larry D. Burns, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 409 days.

(21) Appl. No.: 17/248,320

(22) Filed: Jan. 20, 2021

(65) Prior Publication Data

US 2021/0247096 A1 Aug. 12, 2021

Related U.S. Application Data

(60) Provisional application No. 62/971,322, filed on Feb. 7, 2020.

(51) Int. Cl.
*F24F 11/88* (2018.01)
*F24F 11/33* (2018.01)
(Continued)

(52) U.S. Cl.
CPC ..... *F24F 11/88* (2018.01); *F24F 11/33* (2018.01); *F24F 11/89* (2018.01); *F24F 13/20* (2013.01); *F25B 2400/12* (2013.01)

(58) Field of Classification Search
CPC ..... F24F 11/88
See application file for complete search history.

(56) References Cited

U.S. PATENT DOCUMENTS 4,421,959 A * 12/1983 Chen ..... H01H 9/38 200/243
4,737,603 A 4/1988 Lycan
(Continued)

FOREIGN PATENT DOCUMENTS

CN 205657016 U 10/2016
DE 102014006957 A1 11/2015
(Continued)

OTHER PUBLICATIONS

Extended European Search Report received for EP Application No. 21155313.6, mailed on Jun. 30, 2021, 20 Pages.
(Continued)

*Primary Examiner* — Mohammad Ali
*Assistant Examiner* — Vincent W Chang
(74) *Attorney, Agent, or Firm* — Souad Hakim

(57) ABSTRACT

A contactor, and an air conditioning system incorporating the contactor are provided. The contactor includes a body with an upper surface, a line-side electrical terminal located on one end of the body, a load-side electrical terminal located on the other side of the body, a switching element within the body, the switching element coupled between the line-side electrical terminal and the load-side electrical terminal, and a refrigerant mitigating element disposed on the upper surface. The line-side electrical terminal is configured to receive electrical power from an electrical grid. The load-side electrical terminal is configured to transfer at least a portion of the electrical power to at least one component of the outdoor unit. The switching element is configured to electrically connect the line-side electrical terminal and the load-side electrical terminal when activated. The refrigerant mitigating element may help mitigate the ignition of a refrigerant.

20 Claims, 4 Drawing Sheets

(51) Int. Cl.
*F24F 11/89* (2018.01)
*F24F 13/20* (2006.01)

(56) References Cited

U.S. PATENT DOCUMENTS

| | | | | |
|---|---|---|---|---|
| 6,202,435 | B1 † | 3/2001 | Fujitaka | |
| 8,164,404 | B2 * | 4/2012 | Kamiya | H01H 9/047 335/201 |
| 10,283,286 | B2 † | 5/2019 | Kroepfl | |
| 10,332,697 | B2 | 6/2019 | Stammer | |
| 2008/0078768 | A1 * | 4/2008 | Apostoluk | B32B 29/02 220/560.01 |
| 2013/0063231 | A1 * | 3/2013 | Tomimbang | H01F 7/124 335/127 |
| 2015/0062896 | A1 * | 3/2015 | Doi | C08J 5/18 524/847 |
| 2020/0378657 | A1 * | 12/2020 | Jeung | F25B 39/02 |
| 2020/0408609 | A1 * | 12/2020 | Bhogal | G01K 1/028 |

FOREIGN PATENT DOCUMENTS

| | | | |
|---|---|---|---|
| EP | 2214192 | A2 | 8/2010 |
| JP | H11185584 | A | 7/1999 |
| JP | 2002294051 | A | 10/2002 |

OTHER PUBLICATIONS

Carrier, Comfort 13 Air Conditioner, pp. 1-4, Jul. 13, 2015.†
UL 60335-2-40 Standard for Safety, p. 182, Nov. 1, 2019.†

* cited by examiner
† cited by third party

A2L COMPLIANT CONTACTOR

CROSS REFERENCE TO A RELATED APPLICATION

The application claims the benefit of U.S. Provisional Application No. 62/971,322 filed Feb. 7, 2020, the contents of which are hereby incorporated in their entirety.

BACKGROUND

Air conditioning systems for residential or commercial buildings typically include an outdoor unit and an indoor unit. The indoor unit contains an indoor heat exchanger, which adsorbs heat from the air being passed through the system using a refrigerant when the system is operating in cooling mode. The outdoor unit contains an outdoor heat exchanger, which cools and condenses the gaseous refrigerant when the system is operating in cooling mode. This refrigerant, historically, has been provided as a fluid with a high global warming potential (GWP) value such as R134A or R410A. Although these refrigerants are effective coolants, the effect they can have on the environment has led to the institution of requirements that new refrigerants, which have moderate-to-low GWP values, be employed instead.

Moderate-to-low GWP refrigerants (i.e. A2L refrigerants) can be mildly flammable, however, and thus their use in air conditioning systems can present risks that needs to be addressed. In particular, it may be desirable to ensure that any potential ignition source is contained and separated from the A2L refrigerants. Potential ignition sources may include any component with an open electrical circuit that has enough energy to ignite the refrigerant. One component of conventional air conditioning systems that has a traditionally open electrical circuit is a contactor.

Conventional air conditioning systems utilize contactors for controlling whether electrical power is provided to one or more load devices. For example, the contactor may be used to control the supply of power to a compressor and/or a fan in the outdoor unit of the air conditioning system. Given the institution of requirements that new refrigerants, which have moderate-to-low GWP values be employed, and their potential to be mildly flammable, it is desirable to mitigate any potential ignition of the refrigerant by the contactors.

Accordingly, there remains a need for an A2L compliant contactor for an air conditioning system to help mitigate potential ignition of moderate-to-low GWP refrigerants.

BRIEF DESCRIPTION

According to one embodiment, an air conditioning system with an outdoor unit and at least one contactor used to control the supply of electrical power to the outdoor unit are provided. The outdoor unit includes a compressor for circulating a refrigerant. The contactor includes a body, a line-side electrical terminal, a load-side electrical terminal, a switching element, and a refrigerant mitigating element. The body includes an upper surface. The line-side electrical terminal is located on one end of the body. The line-side electrical terminal is configured to receive the electrical power from an electrical grid. The load-side electrical terminal is located on the other side of the body. The load-side electrical terminal is configured to transfer at least a portion of the electrical power to at least the compressor. The switching element is located, at least partially, within the body. The switching element is coupled between the line-side electrical terminal and the load-side electrical terminal. The switching element is configured to electrically connect the line-side electrical terminal and the load-side electrical terminal when activated. The refrigerant mitigating element is disposed on the upper surface.

In accordance with additional or alternative embodiments, the refrigerant includes at least one A2L refrigerant.

In accordance with additional or alternative embodiments, the at least one A2L refrigerant is R454B.

In accordance with additional or alternative embodiments, the refrigerant mitigating element includes an opening on the upper surface, the opening including a dimension less than or equal to a threshold dimension.

In accordance with additional or alternative embodiments, the threshold dimension is 3.7 millimeters.

In accordance with additional or alternative embodiments, the refrigerant mitigating element is provided by a top surface of the switching element, when activated, being located approximately co-planar with the upper surface.

In accordance with additional or alternative embodiments, the refrigerant mitigating element is provided as an enclosure.

In accordance with additional or alternative embodiments, the enclosure is made of a silicone.

In accordance with additional or alternative embodiments, the refrigerant mitigating element is provided as a flame arresting material.

In accordance with additional or alternative embodiments, the flame arresting material is made at least one of: a mineral wool, a Polybenzimidazole (PBI) fiber, and an Aramid fiber.

In accordance with additional or alternative embodiments, the outdoor unit further includes a fan, the line-side electrical terminal configured to transfer at least a portion of the electrical power to the fan.

According to another aspect of the disclosure, a contactor with a body, a line-side electrical terminal, a load-side electrical terminal, a switching element, and a refrigerant mitigating element is provided. The body includes an upper surface. The line-side electrical terminal is located on one end of the body. The line-side electrical terminal is configured to receive the electrical power from an electrical grid. The load-side electrical terminal is located on the other side of the body. The load-side electrical terminal is configured to transfer at least a portion of the electrical power to at least one component of the outdoor unit. The switching element is located, at least partially, within the body. The switching element is coupled between the line-side electrical terminal and the load-side electrical terminal. The switching element is configured to electrically connect the line-side electrical terminal and the load-side electrical terminal when activated. The refrigerant mitigating element is disposed on the upper surface.

In accordance with additional or alternative embodiments, the refrigerant mitigating element is provided as an opening on the upper surface, the opening the opening including a dimension less than or equal to a threshold dimension.

In accordance with additional or alternative embodiments, the threshold dimension is 3.7 millimeters.

In accordance with additional or alternative embodiments, the refrigerant mitigating element is provided as a top surface of the switching element, when activated, being located approximately co-planar with the upper surface.

In accordance with additional or alternative embodiments, the refrigerant mitigating element is provided as an enclosure.

In accordance with additional or alternative embodiments, the enclosure is made of a silicone.

In accordance with additional or alternative embodiments, the refrigerant mitigating element is provided as a flame arresting material.

In accordance with additional or alternative embodiments, the flame arresting material is made of at least one of: a mineral wool, a Polybenzimidazole (PBI) fiber, and an Aramid fiber.

In accordance with additional or alternative embodiments, the at least one component of the outdoor unit comprises at least one of: a compressor, and a fan.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

Figure 1:
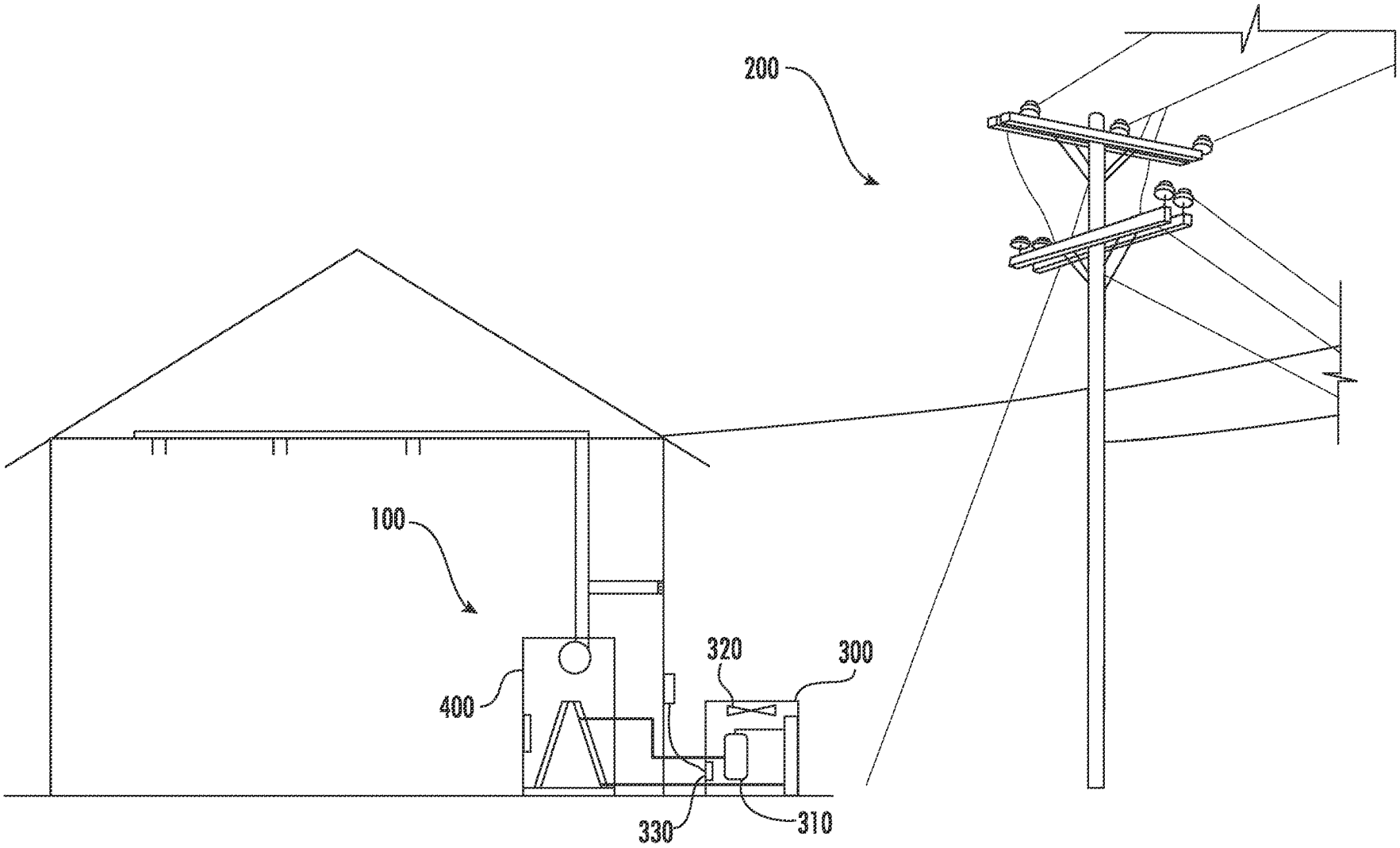
FIG. 1 is a schematic illustration of an air conditioning system receiving electrical power from an electrical grid in accordance with one aspect of the disclosure.

As will be described below, an A2L compliant contactor and an air conditioning system for incorporating the same are provided. The A2L compliant contactor is designed to mitigate potential ignition of A2L refrigerant (e.g., R454B), which may be used within the air conditioning system. To ignite the A2L refrigerant, the A2L refrigerant must be exposed to a high enough energy source. This may be especially possible when the contactor makes or breaks the circuit (e.g., when the switching element makes or breaks the electrical connection between the line-side electrical terminal and the load-side electrical terminal). Mitigating potential ignition of A2L refrigerant, in certain instances, may mean preventing the propagation of a flame outside of the contactor. For example, the contactor may be designed so that if any refrigerant were to come into contact with the electrical circuit within the contactor, the refrigerant, if ignited, would not spread outside the contactor.

The A2L compliant contactor may make it possible to prevent the propagation of a flame outside the contactor by designing the A2L compliant contactor in a manner that prevents, or at least mitigates, the A2L refrigerant from coming into contact with the electrical circuit within the contactor. The A2L compliant contactor may make it possible to prevent the propagation of a flame outside the contactor by designing the A2L compliant contactor in a manner that creates a quenching effect. This quenching effect may be created by limiting the size of any opening between the electrical circuit and the outside of the contactor. In either instance, whether the contactor is designed to prevent refrigerant from coming into contact with the electrical circuit or is designed to create a quenching effect, the A2L compliant contactor may help mitigate potential ignition of moderate-to-low GWP refrigerants (i.e. A2L refrigerants).

The classification of refrigerant is based upon American Society of Heating, Refrigerating and Air-Conditioning (ASHRAE) Standard 34. The standard evaluates each refrigerant's flammability and toxicity and gives it a class referenced as a letter and number combination. The letter refers to the refrigerants toxicity, and is based on the particular refrigerant's occupational exposure limit (OEL). An "A" is given to refrigerants with a 400 ppm or greater OEL. A "B" is given to refrigerants with less than 400 ppm OEL. The number adjacent to the letter refers to the refrigerants flammability, and is based on the burning velocity (BV), heat of combustion (HOC), and lower flammability limits (LFL) of the particular refrigerant. A flammability of "1" is the lowest, with a "3" being the highest. Recently the second class was broken into "2L" and "2". A rating of "2L" indicates that while the refrigerant is still considered flammable, its flammability is much lower than that of class 2 or 3. The A2L compliant contactor may be designed to mitigate potential ignition of at least A2L refrigerants (e.g., R454B).

With reference now to the Figures, a schematic illustration of an air conditioning system 100 receiving electrical power from an electrical grid 200 is shown in FIG. 1. The air conditioning system 100 may be provided for use within a building, such as a residential or commercial building. For purposes of clarity and brevity, however, the following description will relate to the exemplary use of the air conditioning system 100 within a residential building (e.g., a home). The electrical grid 200 may be viewed as the interconnected network for delivering electricity from producers to consumers (e.g., electrical power distributed from one or more distribution line to consumers' homes). This electrical power, in certain instances, may be transferred to the home prior to being transferred to the air conditioning system 100. The air conditioning system 100 may include both an outdoor unit 300 and an indoor unit 400. The outdoor unit 300 may include a compressor 310 for circulating a refrigerant, for example, between the outdoor unit 300 and the indoor unit 400.

Figure 2:
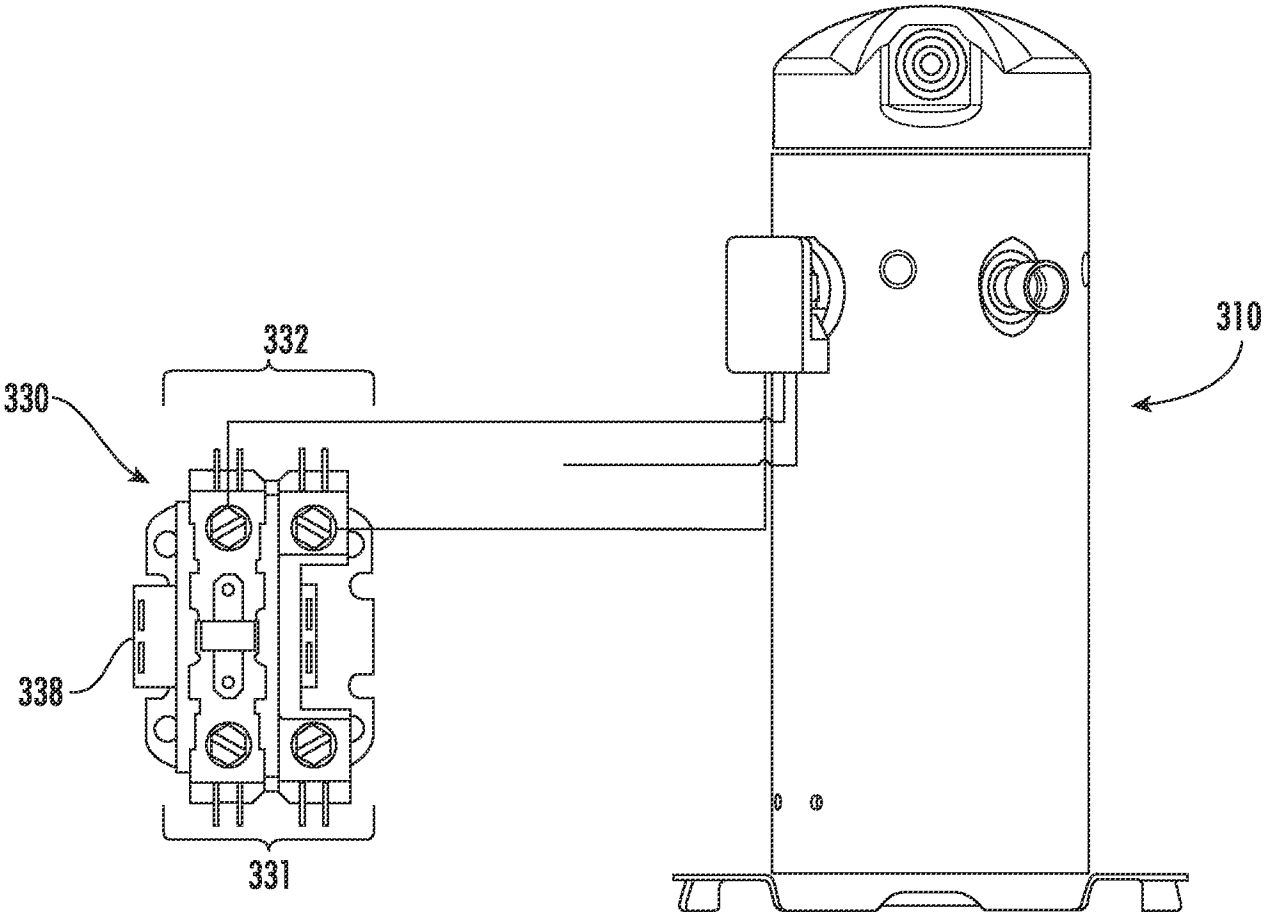
FIG. 2 is a perspective view of a contactor connected to a compressor in accordance with one aspect of the disclosure.

The air conditioning system 100 further includes at least one A2L compliant contactor 330 for controlling the supply of an electrical power to the outdoor unit 300. Although it is envisioned that the A2L compliant contactor 330 be used to mitigate potential ignition of A2L refrigerants, in certain instances, the A2L compliant contactor 330 may be used in any air conditioning system 100 that uses refrigerant that is not classified as A2L (e.g., R134A or R410A). Regardless of the type of refrigerant used, the A2L compliant contactor 330 controls the supply of an electrical power to the outdoor unit 300 (e.g., for a compressor 310 within the outdoor unit 300). An example of the placement of a contactor 330 in connection with a compressor 310 is shown in FIG. 2. The contactor 330 includes a line-side electrical terminal 331, configured to receive electrical power from the electrical grid 200, and a load-side electrical terminal 332, configured to transfer at least a portion of the electrical power to at least the compressor 310 of the outdoor unit 300.

Figure 3:
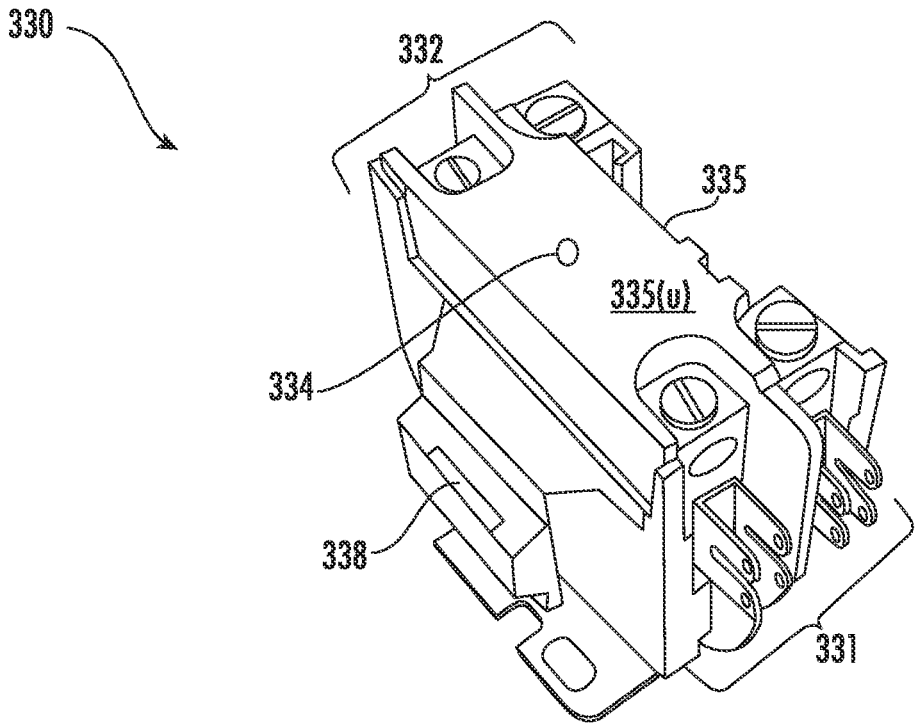
FIG. 3 is a perspective view of a first embodiment of an A2L compliant contactor in accordance with one aspect of the disclosure.
Figure 4:
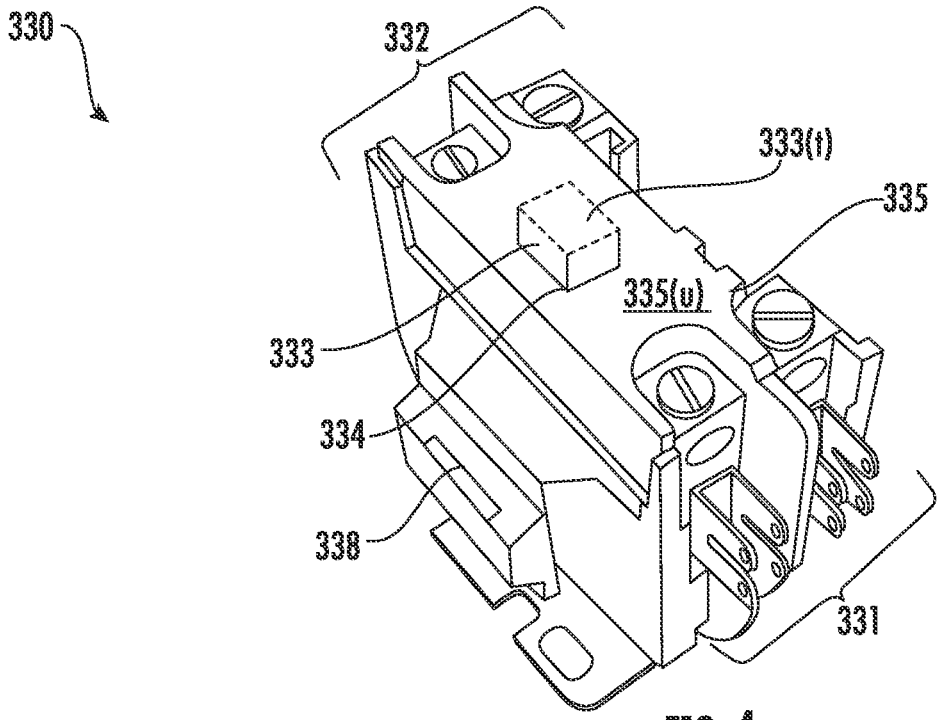
FIG. 4 is a perspective view of a second embodiment of an A2L compliant contactor in accordance with one aspect of the disclosure.
Figure 5:
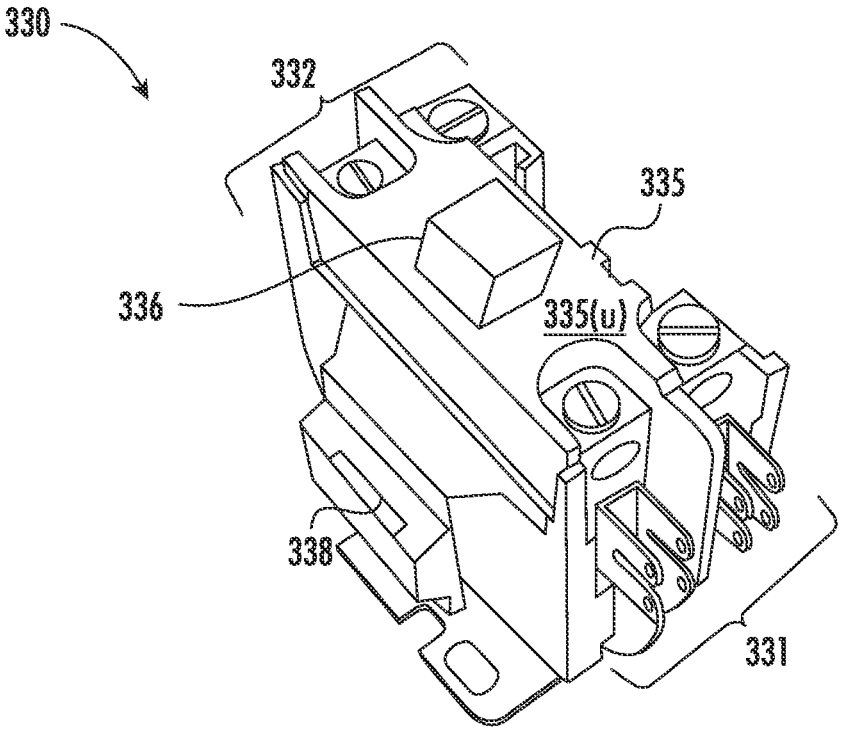
FIG. 5 is a perspective view of a third embodiment of an A2L compliant contactor in accordance with one aspect of the disclosure.
Figure 6:
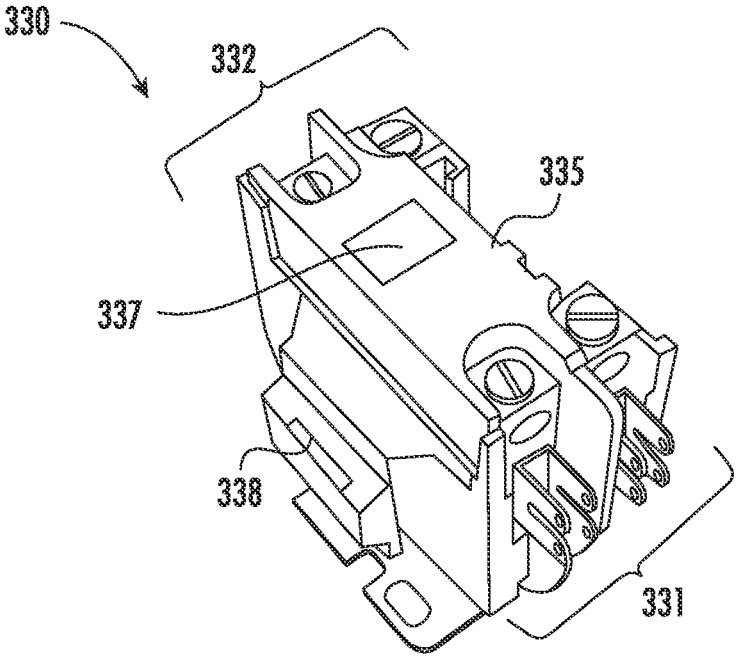
FIG. 6 is a perspective view of a fourth embodiment of an A2L compliant contactor in accordance with one aspect of the disclosure.

The A2L compliant contactor 330, as shown in FIGS. 3-6, includes a body 335 with an upper surface 335(*u*), a line-side electrical terminal 331, a load-side electrical terminal 332, a switching element 333, and a refrigerant mitigating element disposed on the upper surface 335(*u*). The refrigerant mitigating element may be provided as an opening 334 with a dimension less than a threshold dimension (as shown in FIG. 3), a top surface 333(*t*) of the switching element 333 being approximately co-planar with the upper surface 335(*u*) when the switching element 333 is activated (as shown in FIG. 4), an enclosure 336 (as shown in FIG. 5), and/or a flame arresting material 337 (as shown in FIG. 6). Regardless of the configuration, the contactor 330 may be configured to satisfy current safety standards for household electrical appliances.

To activate the switching element 333 and allow the electrical power to pass from the line-side electrical terminal 331 to the load-side electrical terminal 332, the A2L compliant contactor 330 may include one or more quick connect terminal 338. The quick connect terminal 338 may be used to generate a magnetic field, which may activate the switching element 333 (e.g., by pulling the switching element 333 inward, which may cause one or more contact to close, allowing electrical power to pass between the terminals 331, 332) when the magnetic field is present. When the magnetic field is not present, the contacts remain open and the electrical power may not pass from the line-side electrical terminal 331 to the load-side electrical terminal 332. The generation of the magnetic field may be dependent on power being supplied to the quick connect terminal 338, for example, if the power is turned off, the magnetic field may not be present, meaning the contacts will remain open. To manually activate or deactivate the switching element 333 a technician or service professional may manually push the top surface 333(*t*) the switching element 333. The A2L compliant contactor 330 may allow for the manual activation and deactivation of the switching element 333 by designing the switching element 333 to extend above the upper surface 335(*u*) of the contactor 330. The A2L compliant contactor 330 may allow for the manual activation and deactivation of the switching element 333 by designing an opening 334 in the upper surface 335(*u*) of the contactor 330 such that the switching element 333 can be accessed using a tool (e.g., using a rod-like member), without having to disassemble the A2L compliant contactor 330 to expose the switching element 333. It is envisioned that the A2L compliant contactor 330 may allow for both automatic activation, using a magnetic field, and manual activation.

A first embodiment of the A2L compliant contactor 330 is shown in FIG. 3. The A2L compliant contactor 330 includes the body 335 with an upper surface 335(*u*), the line-side electrical terminal 331, the load-side electrical terminal 332, the switching element (not labeled as the switching element is located within the body 335), and the refrigerant mitigating element on the upper surface 335(*u*). The refrigerant mitigating element here is the configuration of an opening 334 with a limited dimension. It is envisioned that the opening 334 may be configured in any shape (e.g. circular, square, etc.). In certain instances, the opening 334 does not have a dimension (e.g., actual diameter or effective diameter) greater than a threshold dimension (e.g. if the refrigerant is R454B, if configured in a circular shape, the actual diameter is less than 3.7 millimeters, or if configured in a square shape, the effective diameter ($d_{eff}$) is not greater than 3.7 millimeters ($d_{eff}=4\times A/S$), where A is the cross sectional area of the opening in squared units and S is the length of the perimeter of the opening). In certain instances, the threshold dimension is between 1.8 millimeters and 7 millimeters, which may be dependent on the type of refrigerant used. By configuring the opening 334 in this manner a quenching effect may be generated. This quenching effect may help prevent the propagation of a flame (e.g., a flame created by the ignition of refrigerant in the contactor 330) through the opening 334.

A second embodiment of the A2L compliant contactor 330 is shown in FIG. 4. The A2L compliant contactor 330 includes the body 335 with an upper surface 335(*u*), the line-side electrical terminal 331, the load-side electrical terminal 332, the switching element 333, and the refrigerant mitigating element. The refrigerant mitigating element here is the configuration of a top surface 333(*t*) of the switching element 333 to be approximately co-planar with the upper surface 335(*u*) when the switching element 333 is activated. By configuring the top surface 333(*t*) of the switching element 333 to be approximately co-planar with the upper surface 335(*u*) when the switching element 333 is activated, potential ignition of the refrigerant may be mitigated. Approximately co-planar may be viewed to mean that that the top surface 333(*t*) of the switching element 333 does not, or does not substantially extend below the upper surface 335(*u*) of the body 335 when the switching element 333 is activated. By configuring the A2L compliant contactor 330 in this manner, there is minimal opening 334 above the switching element 334 when the switching element 333 is activated. It is envisioned that any opening 334 around the switching element 333 has a limited dimension so as to generate a quenching effect. This quenching effect may help prevent the propagation of a flame through the opening 334.

A third embodiment of the A2L compliant contactor 330 is shown in FIG. 5. The A2L compliant contactor 330 includes the refrigerant mitigating element (depicted as an enclosure 336 over the switching element 333 (not labeled as the switching element 333 is within the enclosure 336)). This enclosure 336 may be provided to have a perimeter that is larger than the perimeter of any opening 334 (not labeled as the enclosure 336 covers the opening 334). This enclosure 336 may be made of any suitable material capable of preventing refrigerant from passing through the material, for example, a silicone. This embodiment of the A2L compliant contactor 330 may make it possible to prevent the propagation of a flame outside the contactor 330 by preventing, or at least mitigating, the refrigerant from coming into contact with the electrical circuit within the contactor 330. For example, by using an enclosure 336 over the switching element 333, when the switching element 333 is activated (e.g., being pushed inward through the upper surface 335(*u*) of the A2L compliant contactor 330), there is no uncovered opening for the refrigerant to pass through. This may help prevent the refrigerant from coming into contact with the electrical circuit within the contactor 330, which may help prevent ignition of the refrigerant.

A fourth embodiment of the A2L compliant contactor 330 is shown in FIG. 6. The A2L compliant contactor 330 includes the refrigerant mitigating element (depicted as a flame arresting material 337 over the opening 334 (not labeled as the opening 334 is covered by the flame arresting material 337). This flame arresting material 337 may be configured to shield the switching element 333 from refrigerant. This flame arresting material 337 may be made of any suitable material capable of preventing the propagation of a flame (e.g., a flame created by the ignition of refrigerant in the contactor 330) through the flame arresting material 337, for example, at least one of: a mineral wool, a Polybenzimidazole (PBI) fiber, and an Aramid fiber. This embodiment of the A2L compliant contactor 330 may make it possible to prevent the propagation of a flame outside the contactor 330 by creating a quenching effect. This quenching effect may be created due to the size of the opening(s) (e.g., which may be viewed as the pores between the fiber) in the flame arresting material 337, for example, when being made a mineral wool, the fibers of the mineral wool may be so closely packed that there is no opening in the flame arresting material 337 greater than a threshold dimension (e.g., 3.7 millimeters in diameter when R454B is used as the refrigerant). As stated above, the threshold dimension may be dependent, at least in part, on the type of refrigerant used.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An air conditioning system, comprising:

an outdoor unit comprising a compressor for circulating a refrigerant; and at least one contactor for controlling the supply of an electrical power to the outdoor unit, the at least one contactor comprising:

a body comprising an upper surface;

a line-side electrical terminal located on one end of the body, the line-side electrical terminal configured to receive the electrical power from an electrical grid;

a load-side electrical terminal located on the other side of the body, the load-side electrical terminal configured to transfer at least a portion of the electrical power to at least the compressor;

a switching element located, at least partially, within the body, the switching element coupled between the line-side electrical terminal and the load-side electrical terminal, the switching element configured to electrically connect the line-side electrical terminal and the load-side electrical terminal when activated; and a refrigerant mitigating element disposed on the upper surface, wherein the refrigerant mitigating element comprises an opening, the opening being configured to allow activation and deactivation of the switching element through the opening, the switching element being co-planar with the upper surface when the switching element is activated.

2. The air conditioning system of claim 1, wherein the refrigerant comprises at least one A2L refrigerant.

3. The air conditioning system of claim 2, wherein the at least one A2L refrigerant is R454B.

4. The air conditioning system of claim 1, wherein the opening comprises a dimension less than or equal to a threshold dimension.

5. The air conditioning system of claim 4, wherein the threshold dimension is 3.7 millimeters.

6. The air conditioning system of claim 1, wherein the refrigerant mitigating element comprises a top surface of the switching element, when activated, located approximately co-planar with the upper surface.

7. The air conditioning system of claim 1, wherein the refrigerant mitigating element comprises an enclosure.

8. The air conditioning system of claim 7, wherein the enclosure is comprised of a silicone.

9. The air conditioning system of claim 1, wherein the refrigerant mitigating element comprises a flame arresting material.

10. The air conditioning system of claim 9, wherein the flame arresting material comprises at least one of: a mineral wool, a Polybenzimidazole (PBI) fiber, and an Aramid fiber.

11. The air conditioning system of claim 1, wherein the outdoor unit further comprises a fan, wherein the line-side electrical terminal is configured to transfer at least a portion of the electrical power to the fan.

12. A contactor, comprising:

a body comprising an upper surface;

a line-side electrical terminal located on one end of the body, the line-side electrical terminal configured to receive the electrical power from an electrical grid;

a load-side electrical terminal located on the other side of the body, the load-side electrical terminal configured to transfer at least a portion of the electrical power to at least one component of the outdoor unit;

a switching element located, at least partially, within the body, the switching element coupled between the line-side electrical terminal and the load-side electrical terminal, the switching element configured to electrically connect the line-side electrical terminal and the load-side electrical terminal when activated; and a refrigerant mitigating element disposed on the upper surface, wherein the refrigerant mitigating element comprises an opening configured to allow activation and deactivation of the switching element through the opening, the switching element being co-planar with the upper surface when the switching element is activated.

13. The contactor of claim 12, wherein the opening comprises a dimension less than or equal to a threshold dimension.

14. The contactor of claim 12, wherein the threshold dimension is 3.7 millimeters.

15. The contactor of claim 12, wherein the refrigerant mitigating element comprises a top surface of the switching element, when activated, located approximately co-planar with the upper surface.

16. The contactor of claim 12, wherein the refrigerant mitigating element comprises an enclosure.

17. The contactor of claim 16, wherein the enclosure is comprised of a silicone.

18. The contactor of claim 12, wherein the refrigerant mitigating element comprises a flame arresting material.

19. The contactor of claim 18, wherein the flame arresting material comprises at least one of: a mineral wool, a Polybenzimidazole (PBI) fiber, and an Aramid fiber.

20. The contactor of claim 12, wherein the at least one component of the outdoor unit comprises at least one of: a compressor, and a fan.

* * * * *